United States Patent [19]

Rushing et al.

[11] Patent Number: 5,022,539

[45] Date of Patent: Jun. 11, 1991

[54] TWO-WAY TRAY DISPLAY

[75] Inventors: Tatsuo Rushing, Denville, N.J.; Christopher Kidd, New York, N.Y.

[73] Assignee: Marlboro Marketing, Inc., New York, N.Y.

[21] Appl. No.: 460,677

[22] Filed: Jan. 5, 1990

[51] Int. Cl.[5] ..... A47F 3/14

[52] U.S. Cl. ..... 211/133; 108/108

[58] Field of Search ..... 211/133, 160, 170, 88; 108/108, 39, 47, 48; 248/242, 291

[56] References Cited

U.S. PATENT DOCUMENTS

| | | | |
|---|---|---|---|
| 4,122,954 | 10/1978 | Slater | 211/133 |
| 4,204,480 | 5/1980 | Hanna | 108/108 |
| 4,250,815 | 2/1981 | Swanson | 108/108 |
| 4,706,823 | 11/1987 | Visser | 211/133 |
| 4,744,474 | 5/1988 | Tallvine | 211/133 |
| 4,901,872 | 2/1990 | Lane | 211/133 |
| 4,913,501 | 4/1990 | Swank | 211/133 X |

*Primary Examiner*—Ramon O. Ramirez
*Attorney, Agent, or Firm*—Darby & Darby

[57] ABSTRACT

A display for supporting merchandise includes a two-sided tray having a flat surface on one side and on the reverse side, a surface adapted to engage peg hooks. The tray is pivotably connected to a vertical support structure by means of a bracket that connects at one portion to the tray and at another portion to the support structure. In one position of the tray, the flat surface is horizontal and merchandise may be placed on top of the tray. In a second position of the tray, the tray is vertical with the hook engaging means exposed. Latching means maintains the tray in the vertical position when the hook engaging mode of use is desired. A plurality of trays are supported, one over the other on the support structure and each tray may be positioned individually in the horizontal or vertical position without regard to the orientation of any other tray.

11 Claims, 8 Drawing Sheets

TWO-WAY TRAY DISPLAY

BACKGROUND OF THE INVENTION

This invention relates generally to a merchandise display device for supporting merchandise thereon, and more particularly concerns a two-way tray display providing either tray support or hanging support for merchandise. Many items of merchandise, especially smaller items, are intended for display on trays or shelves or for hanging by hooks from specially designed display devices. Such devices are either in the form of shelving or boards or racks from which hooks may be suspended, with the merchandise suspended at the other end of the same hook. Whereas the merchant generally has a need for both types of display devices, these devices are usually designed to provide only one mode of display, that is, they either provide shelving or trays or they provide hanging capability for the merchandise. Thus, the merchant is compelled, if the merchandise is to be properly displayed, to have both types of display devices. As different merchandise becomes available for display, it may be necessary to remove one display device from the selling floor and replace it with the other type device. This is time consuming and inconvenient.

What is needed is a display device which can provide alternatively, trays for supporting merchandise, surfaces to which hooks attached to merchandise may be attached for displaying the merchandise, and simultaneously, both trays for supporting merchandise and hook fastening capability for displaying hanging merchandise.

SUMMARY OF THE INVENTION

Accordingly, it is an object of this invention to provide an improved tray display that selectively provides either trays or hook receiving means for merchandise display.

Another object of this invention is to provide an improved tray display that can simultaneously provide trays and hook receiving means for display of merchandise.

A further object of this invention is to provide an improved tray display that is either free standing or wall supported.

Yet another object of this invention is to provide an improved tray display that is attractive in appearance and economical to produce.

Generally speaking, the display in accordance with the invention for supporting merchandise includes a two-sided tray having a flat surface on one side and on the reverse side, a surface that is adapted to engage peg hooks. The tray is pivotably connected to a vertical support structure by means of a bracket that connects at one portion to the tray and at another portion to the support structure. In one position of the tray, the flat surface is horizontal and merchandise may be placed on top of the tray. In a second position of the tray, the tray is vertical with the hook engaging means exposed. Latching means maintains the tray in the vertical position when the hook engaging mode of use is desired. A plurality of trays are supported, one over the other on the support structure and each tray may be positioned individually in the horizontal or vertical position without regard to the orientation of any other tray.

Other objects, features and advantages of the invention will be apparent from the specification. This invention accordingly comprises the features of construction, combination of elements and arrangement of parts which will exemplified in the constructions hereinafter set forth, and the scope of the invention will be indicated in the appended claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 2:
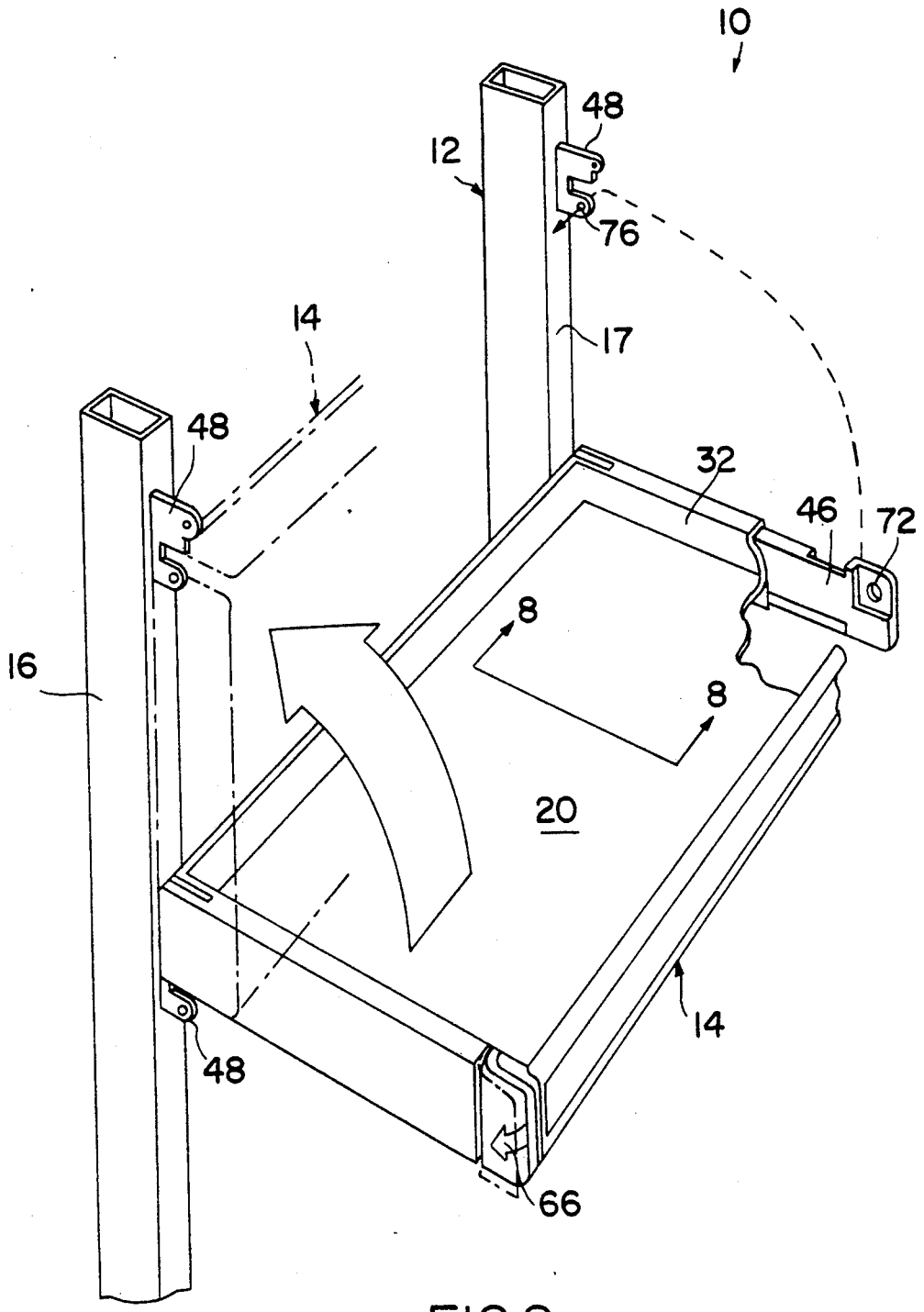
FIG. 2 is a top perspective view of the display in accordance with the invention with a tray assembly attached to the support frame of FIG. 1.

A two-way tray display 10 in accordance with the invention includes a support frame or structure 12 to which a plurality of tray assemblies 14 are mounted. Only one tray assembly 14 is illustrated in FIG. 2 although the number of tray assemblies is not so limited as will become apparent from the description hereinafter.

The support frame 12 includes a pair of vertical rectangular posts or channels 16, 17 that are connected together at their top ends by a cross bar 18, which is also a rectangular channel, so that a rigid connection is formed, for example, with miter joints, as illustrated.

Feet 20, 21 extend horizontally away from the vertical channels 16, 17, respectively, and are connected by a cross-bar 22. The feet 20, 21 and cross bar 22 are of the same rectangular channel construction as the vertical channels 16, 17 and the frame 12 is connected together by any suitable means to form a rigid structure. The front faces 24 of the channels 16, 17 have pairs of vertically oriented slits passing therethrough. The pairs of slits 26 are uniformly spaced apart in the vertical direction.

Figure 7:
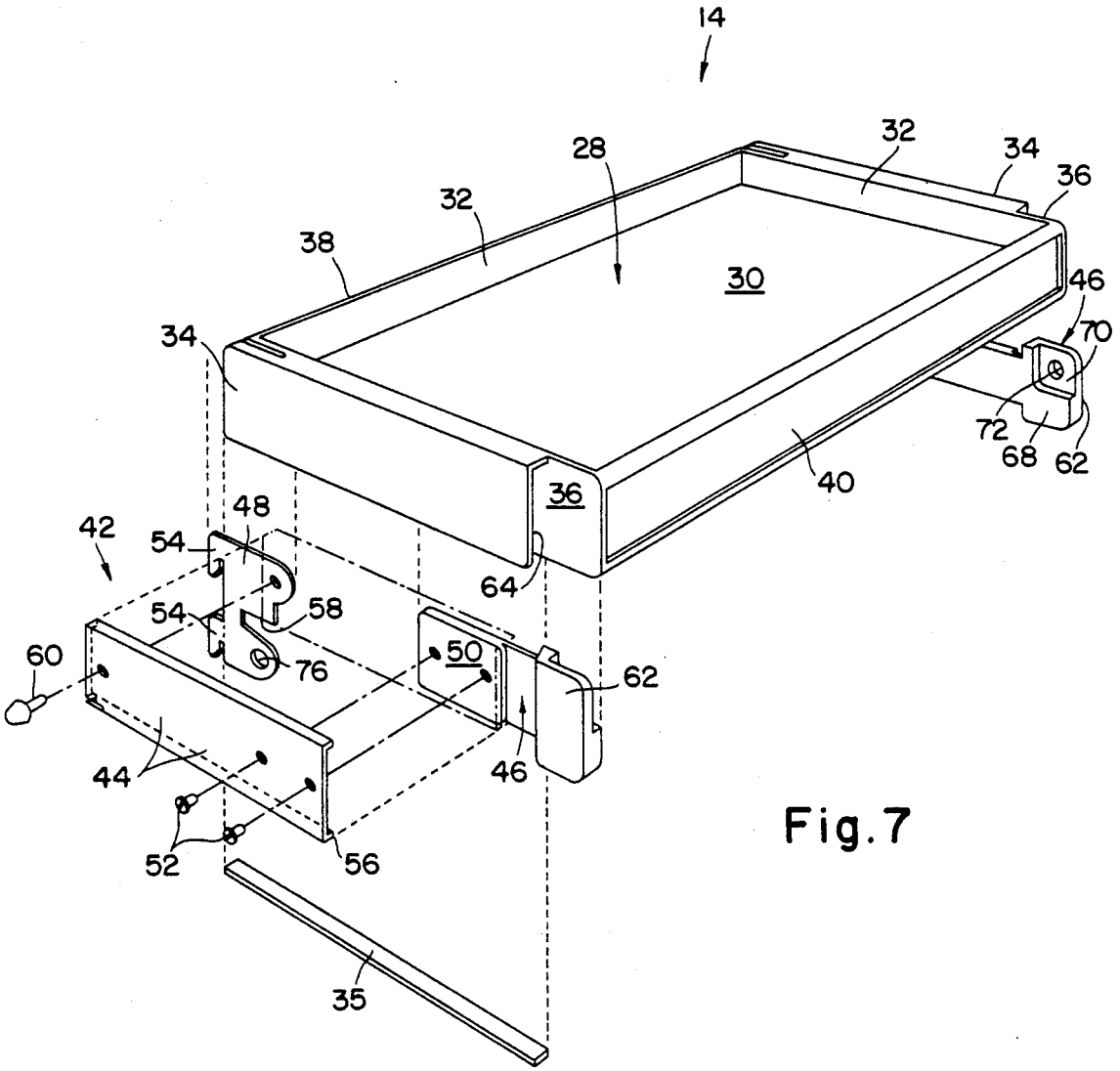
FIG. 7 is an exploded view in perspective of the tray assembly in accordance with the invention.

The tray assembly 14 includes a tray 28 having a flat support surface 30 entirely surrounded by substantially vertical walls 32 such that merchandise may be supported on the surface 30 with little risk of falling off the tray 28. Wings 34, having an inverted L-shape, attach to the sides 36 of the tray 28 extending from the rear of the tray, toward the front surface 40 of the tray 28 as illustrated in FIG. 7.

Arm assemblies 42, which support the tray 28 at both sides and connect to the support frame 12, each include a support arm 44, locking plate 46 and bracket 48. The arm 44 is a shallow channel and the locking plate 46 is received at one end 50 between the channel flanges and is retained there by any suitable means, for example, screws 52 which pass through clearance holes in the support arm 44 and engage the locking plate 46.

Figure 4:
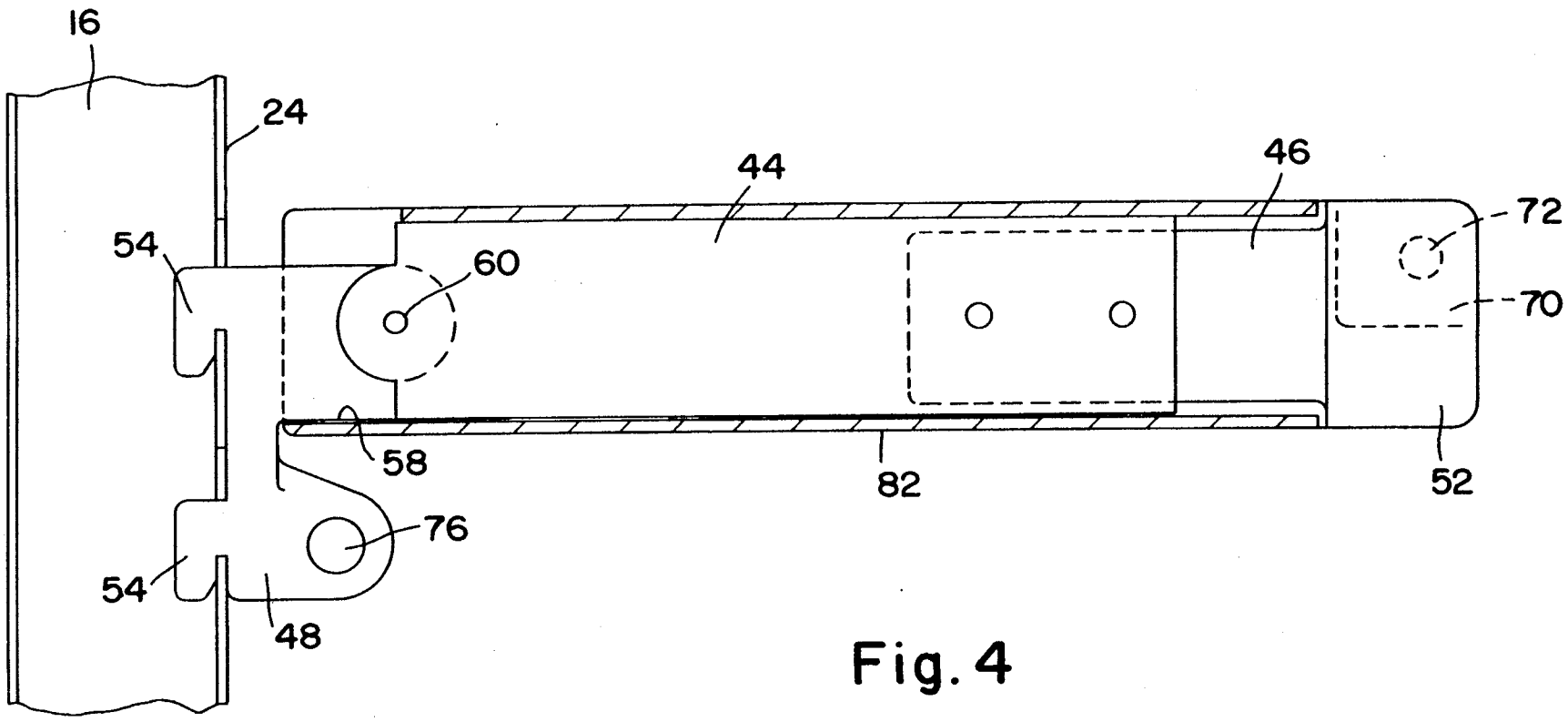
FIG. 4 is a sectional view taken along the line 4—4 of FIG. 3.

A rivet 60 pivotably connects the bracket 48 to the support arm 44 at the rear end thereof such that the bracket 48 nests partially within the flanges of the support arm 44. A pair of hooks 54 extend from the rear edge of the bracket 48 and are spaced apart so as to be received in a pair of slits 26 in the front faces 24 of the channels 16, 17. Contact between the lower flange 56 of the support arm 44 with the lower edge 58 of the upper portion of the bracket 48, prevents the support arm 44 from pivoting downwardly about the rivet 60 which passes through holes in both the support arm 44 and bracket 48 to rotatably join these two elements. Rotation of the tray assembly 14 about the rivet 60 is limited to counter clockwise rotation from the horizontal position, as viewed in FIGS. 2 and 4.

The arm assemblies 42 are received in respective U-shaped channels formed between the tray sides 36 and the L-shaped wings 34 of the tray 28. The offset portion 62 of the locking plate 46 is received between the side 36 of the tray 28 and the front edge 64 of the L-shaped wing 34. A cover plate 35 spans the gap between the depending portion of the wing 34 and the tray side 36 so as to prevent separation of the arm assembly 42 from the tray 28.

Figure 3:
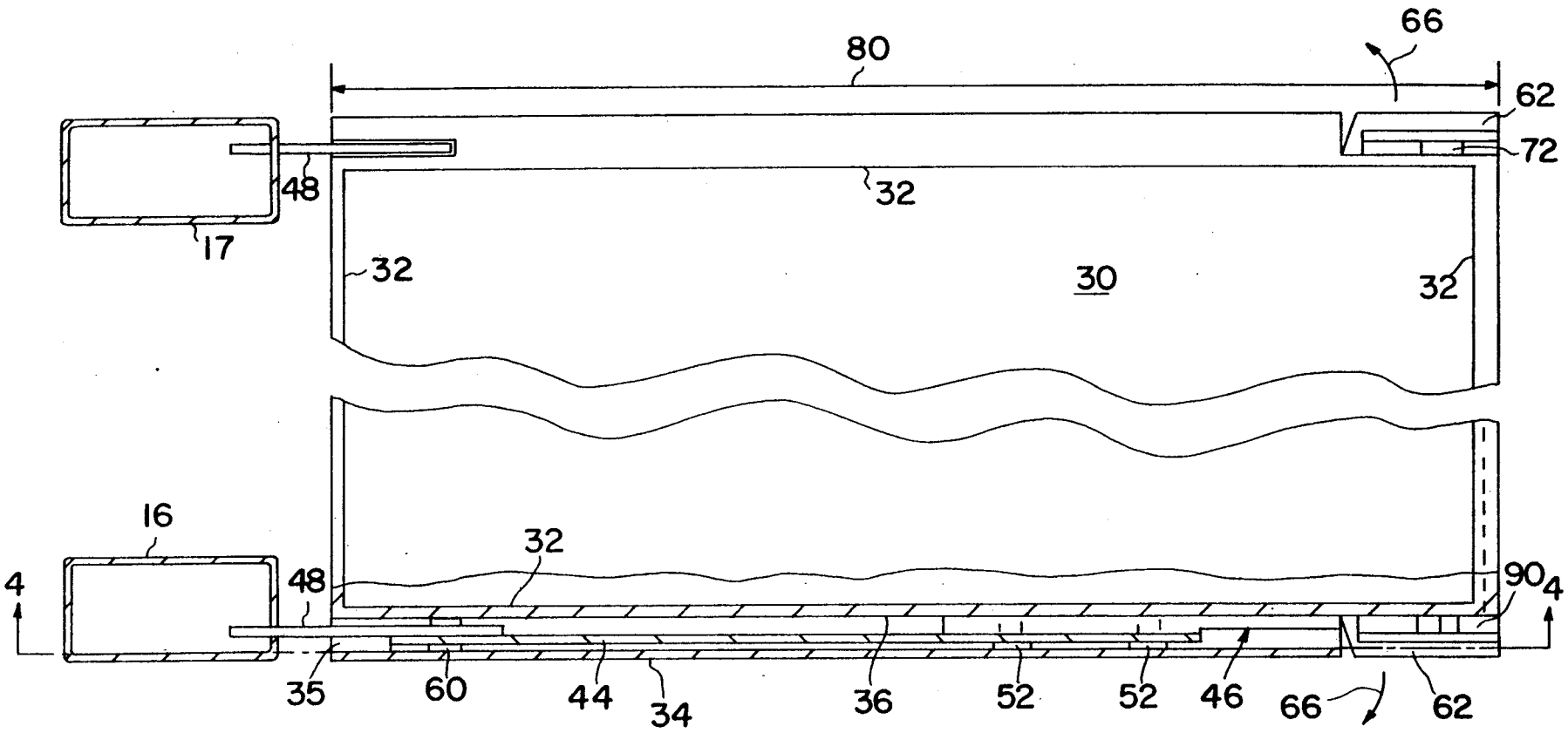
FIG. 3 is a top view, partly sectioned, of a tray attached to the support frame.
Figure 5:
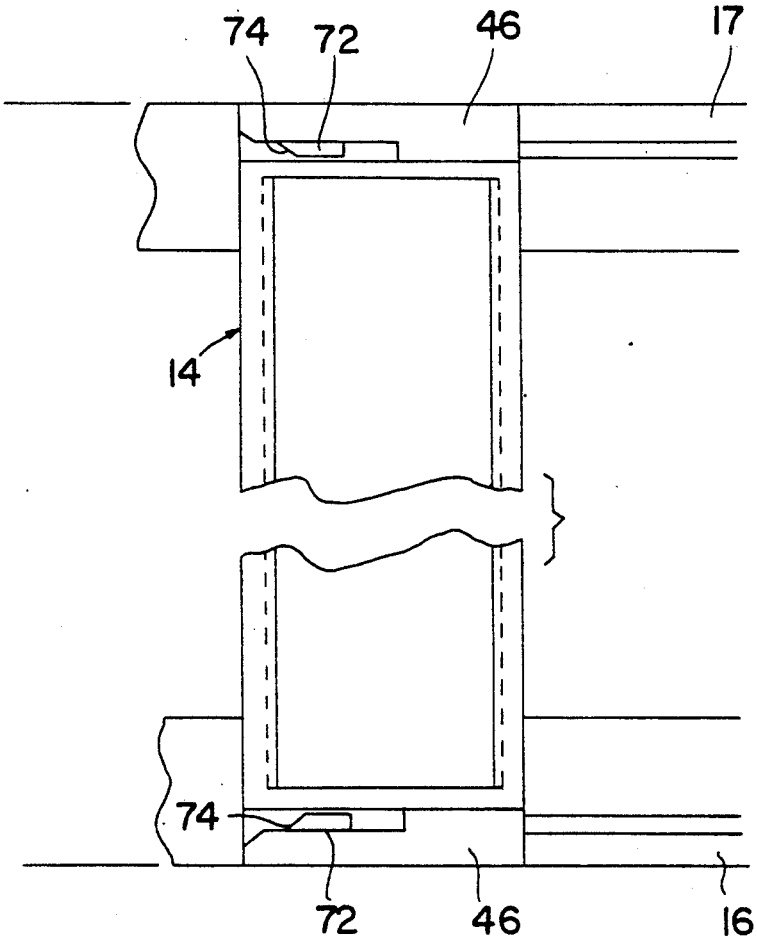
FIG. 5 is an end elevational view of the tray attached to the support frame.
Figure 6:
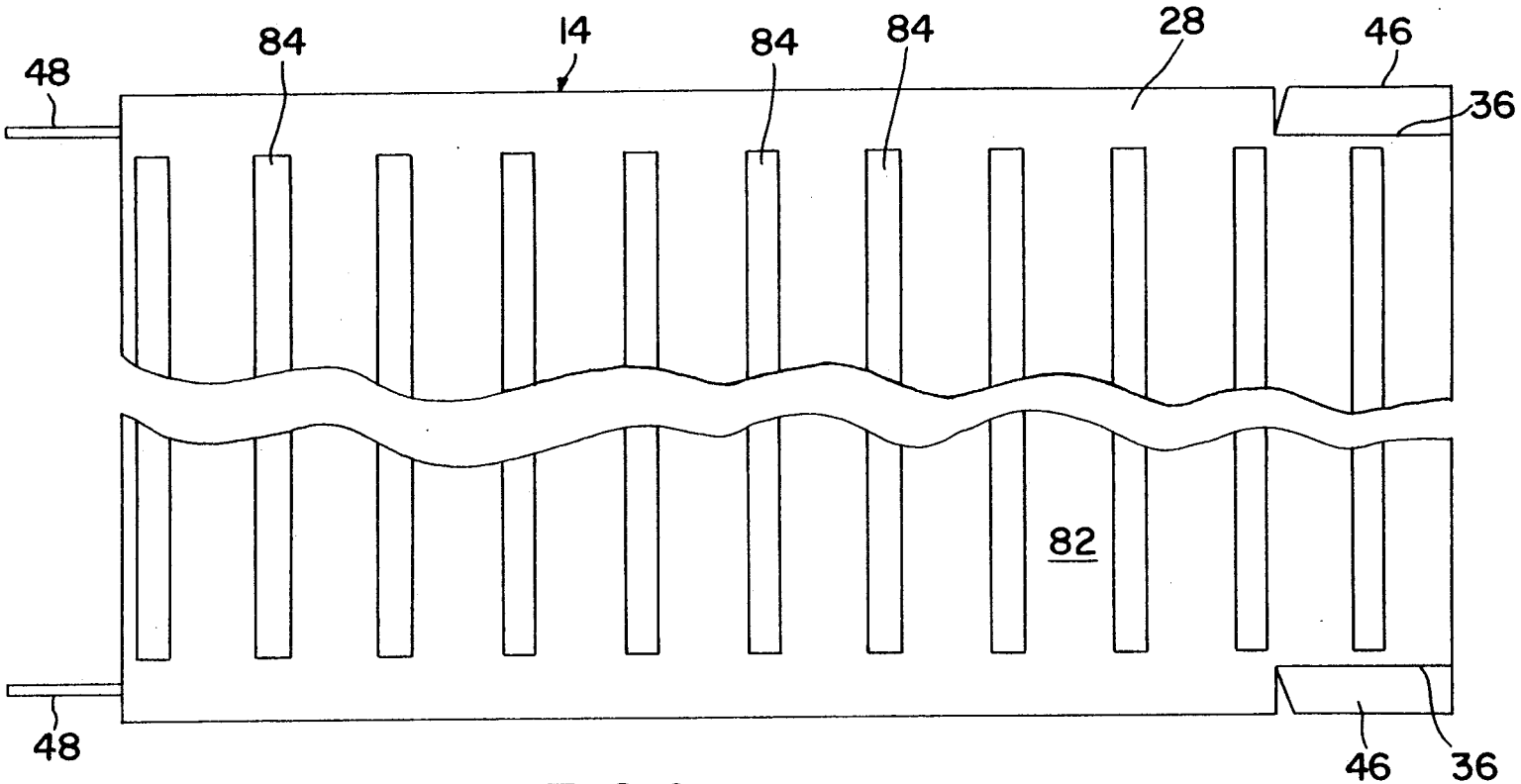
FIG. 6 is a bottom view of the tray of FIGS. 3–5.

The locking plate 46 is fabricated of resilient material, for example, plastic, such that the offset portion 62 may be flexed outwardly in the directions indicated by the arrows 66 (FIGS. 2, 3). The inner surface 68 of the offset portion 62 of the locking plate 46 has a two sided recess 70. A locating pin 72 extends inwardly toward the side 36 of the tray 28 in an assembled tray assembly 14. As best illustrated in FIG. 5, each locating pin 72 has a bevel 74 on one side, this side being the upper portion of the pin 72 in actual use of the tray display in accordance with the invention.

When a tray assembly 14 is pivoted in a counterclockwise direction (FIG. 2), from a horizontal position the pins 72 contact the lower portions of the brackets 48, which brackets are the next brackets 48 on the support frame 12 above the brackets 48 to which the particular tray assembly 14 is attached. By applying pressure on the tray assembly 14 in the counterclockwise direction, the bevel 74 of the locating pin 72 rides up onto the bracket, and, with outward flexing of the locking plates 46 in the direction of the arrows 66, the locking pins 72 seat in the holes 76, respectively, in the brackets 48 next above the brackets 48 which are supporting the tray assembly 14. The bevel surface 74 of the locating pin 72 acts as a cam that facilitates flexing of the locking plate 46 and ultimate engagement of the pin 72 in the hole 76.

Figure 1:
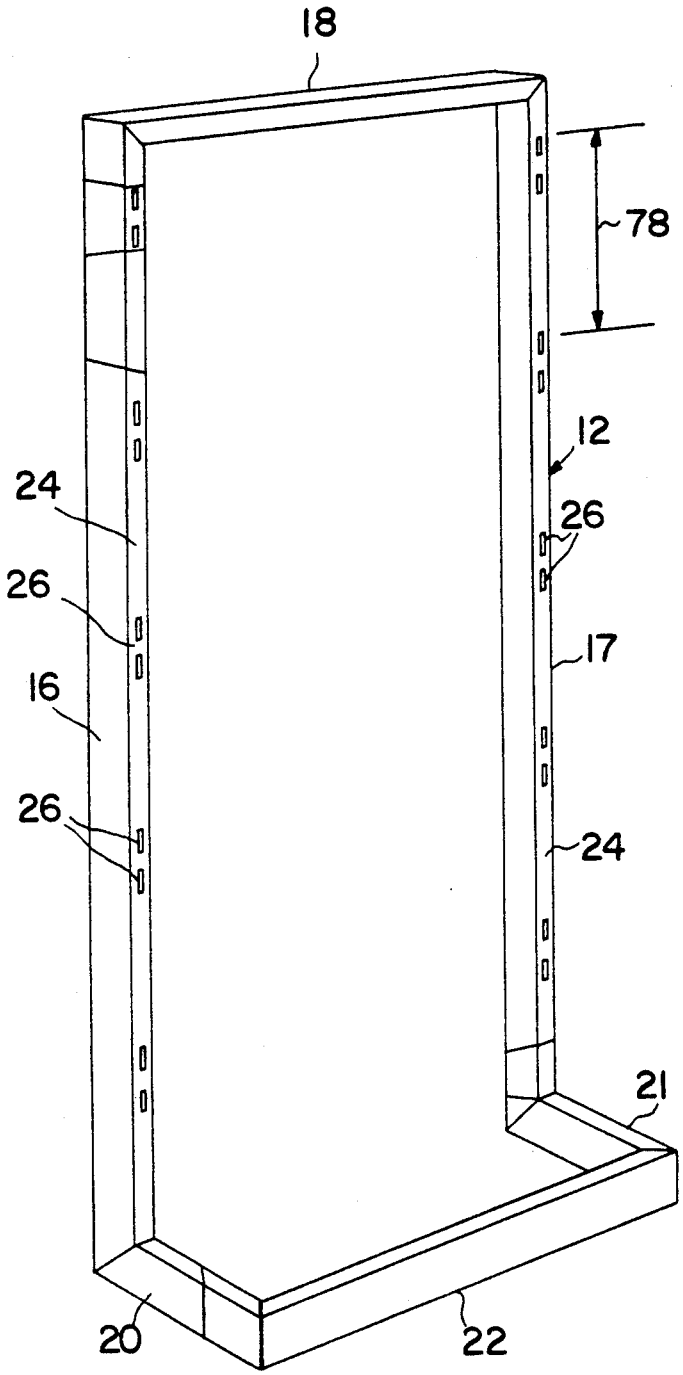
FIG. 1 is a support frame for the two-way tray display in accordance with the invention.

Because a tray assembly 14 in the vertical position is engaged at each side with two vertically adjacent brackets 48 on the same post 16, 17, the spacing 78 between brackets is selected to accommodate the rear to front length 80 of the tray 28 without any interference. Thus, on the support frame 12 of FIG. 1, four tray assemblies 14 may be accommodated in either the horizontal or vertical positions in the four lower pairs of slits 26 on each side post 16, 17, and another tray, supported only in the horizontal position, may be accommodated in the uppermost slits 26 of the posts 16, 17. It should be apparent, that the number of tray assemblies 14 that may be provided in a display 10 in accordance with the invention depends upon the vertical length of the posts 16, 17 and the number of slits 26 provided therein. Also, it should be understood that in an alternative embodiment of a two-way tray display in accordance with the invention, the trays may have different rear-to-front dimensions 80 so long as the slits 26 are properly positioned to accommodate the associated brackets 48. In alternative embodiments in accordance with the invention, the display 10 may include trays of different rear-to-front lengths 80 in one overall display.

Figure 8:
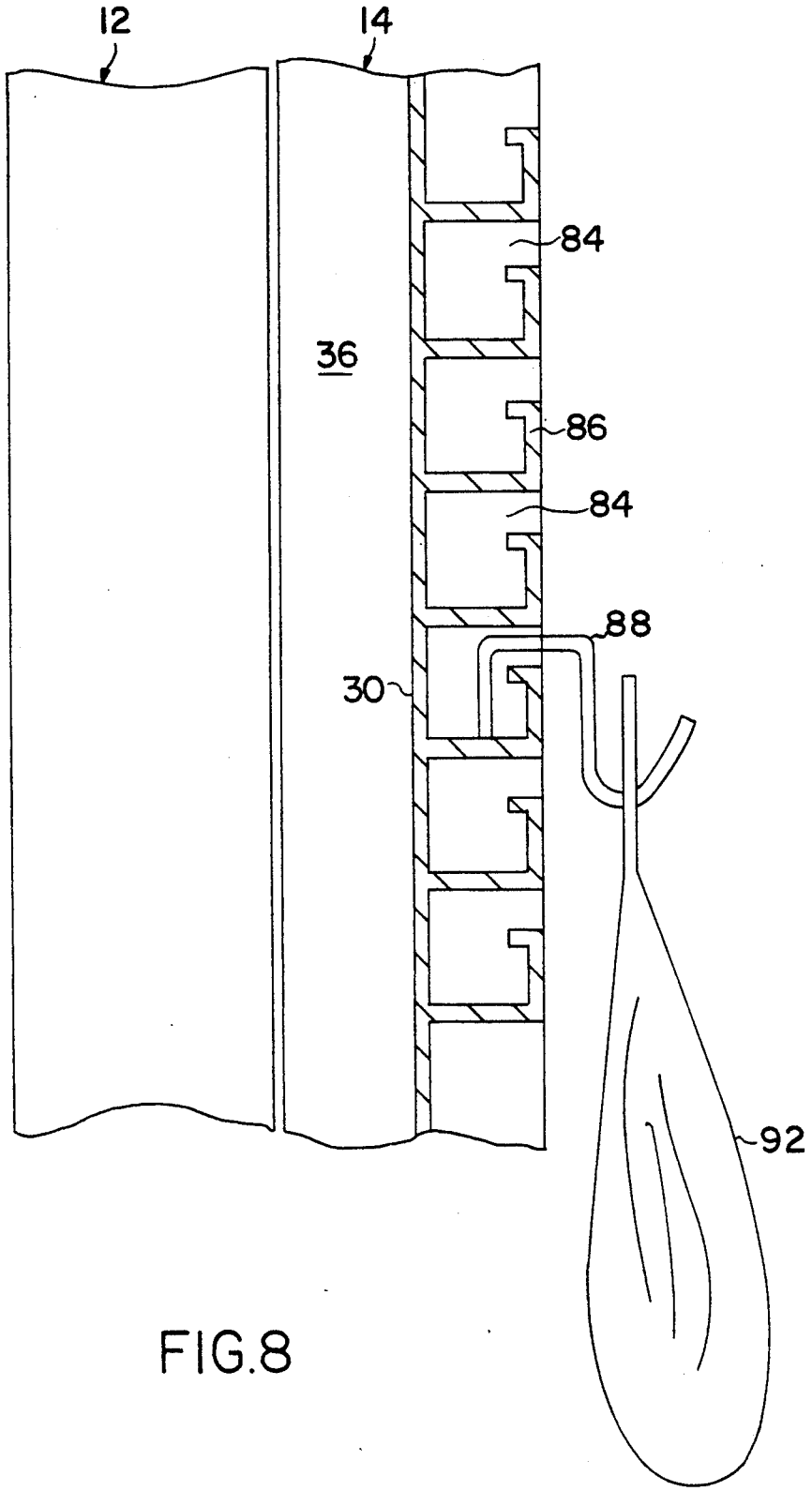
FIG. 8 is a sectional view of a tray taken along the line 8—8 of FIG. 2.

When a tray assembly 14 is pivoted from a horizontal orientation to the vertical position, (broken lines in FIG. 2), the bottom surface 82 of a horizontal tray assembly 14 becomes the vertical outwardly facing surface of the display 10. Slots 84 are formed in the back surface 82 of the tray 28. The slots 84 are spaces between a plurality of L-shaped elements 86 (FIG. 8) which attach at one end to the support surface 30 and extend laterally toward the sides 36 of the tray 28. When the tray assembly 14 is in the vertical position (FIG. 8), the slots 84 are horizontally oriented and suited to receive a hook 88 from which merchandise can be hung. In FIG. 8, a bagged object 92 or goods is illustrated, hung from the other end of the hook 88.

Thus, the display 10 in accordance with the invention provides horizontal trays when the arm assemblies 42 extend horizontally from the support frame 12 and presents the slots 84 for connection of merchandise, using intermediate hooks, when tray assembly 14 is pivoted about the rivets 60 such that the arm assemblies 42 are vertical and the tray 28 is vertical.

When the locating pins 72 on the locking plates 46 on opposite sides of the tray assembly 14 engage the holes 76 in the brackets 48, the individual tray assembly 14 is retained in the vertical position for attachment of merchandise by means of hooks. To release a tray assembly 14 from this vertical position, it is only necessary to flex the offset portions 62 of the locking plates 46 in the directions of the arrows 66 until the locating pins 72 disengage from the bracket holes 76. Depending upon the construction materials, for example, plastic material, of the locking plate 46, this flexing can be accomplished with finger pressure or by inserting a screwdriver or coin in the gap 90 (FIG. 3) between the tray 28 and locking plate 46 and twisting the coin or screwdriver.

Although a free-standing support frame or structure 12 has been described above, it should be understood that the trays 28 can be connected by their brackets 48 to strips (not shown) attached to a wall, said strips having vertical slits 26 provided therein. This is similar to the constructions used for wall mounted bookshelves. Further, in other alternative embodiments of a display in accordance with the invention, the hook receiving slots 84 on the reverse side of the tray 28 may be replaced with any type of hook attachment means, for example a peg board, or any other attachment system, for example, velcro patches that mate with corresponding material on the merchandise.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense. It is also to be understood that the following claims are intended to cover all of the generic and specific features of the invention herein described and all statements of the scope of the invention which might be said to fall therebetween.

What is claimed is:

1. A two-way display for supporting merchandise, comprising:

a two sided tray having a first means for supporting merchandise on one side thereof and a second means for supporting merchandise on the opposite side thereof, said tray having a rear edge and a front edge, a bracket pivotably connected at a first portion of said bracket to said tray proximate said rear edge, a second portion of said bracket including means for attachment to a support structure, said tray being pivotable between a first position and a second position relative to said bracket, in said first position said first means for supporting merchandise being in position to support merchandise, and in said second position said second means for supporting merchandise being in position to support merchandise, and means for releasable locking connection of said tray to said support structure when said tray is in said second pivoted position.

2. A two-way display as in claim 1, wherein said means for supporting merchandise on said one side of said tray is a flat surface, said surface being substantially horizontal when said tray is in said first position.

3. A two-way display as in claim 1, wherein said means for supporting merchandise on said opposite side of said tray is a means for receiving and engaging hood means having an end for holding said merchandise, said tray being substantially vertically oriented when said tray is in said second position.

4. A two-way display as in claim 2, wherein said means for supporting merchandise on said opposite side of said tray is a means for receiving and engaging hook means having an end for holding said merchandise, said tray being vertically oriented when said tray is in said second position.

5. A two-way display as in claim 1, further comprising a vertical support structure including means for joining with a plurality of said brackets at said means for attachment to a support structure on said brackets, said plurality of brackets and pivotably associated trays being positionable on said support structure one above the other and spaced apart.

6. A two-way display as in claim 4, wherein a pair of said brackets are connected to opposite sides of said tray proximate said rear edge of said tray.

7. A two-way display as in claim 5, wherein said support structure is free standing.

8. A two-way display for supporting merchandise, comprising:

a two sided tray having a first means for supporting merchandise on one side thereof and a second means for supporting merchandise on the opposite side thereof, said tray having a rear edge and a front edge, a bracket pivotably connected at a first portion of said bracket to said tray proximate said rear edge, a second portion of said bracket including means for attachment to a support structure, said tray being pivotable between a first position and a second position relative to said bracket, in said first position said first means for supporting merchandise being in position to support merchandise, and in said second position said second means for supporting merchandise being in position to support merchandise, and means for releasable connection of said tray to said support structure when said tray is in said second pivoted position, said means for releasable connection including a pin, said display further comprising a support structure having a pin receptacle connected to said support structure for receiving said pin when said tray is in said second position.

9. A two-way display as in claim 8, wherein said pin extends parallel to the pivoting axis of said tray relative to said bracket, said pin being flexibly mounted to said tray, flexing said pin permitting entry of said pin into said pin receptacle to hold said tray in said second position.

10. A two-way display as in claim 9, wherein said bracket includes a pin receptacle.

11. A two-way display for supporting merchandise, comprising:

a two sided tray having a first means for supporting merchandise on one side thereof and a second means for supporting merchandise on the opposite side thereof, said tray having a rear edge and a front edge, a bracket pivotably connected at a first portion of said bracket to said tray proximate said rear edge, a second portion of said bracket including means for attachment to a support structure, said tray being pivotable between a first position and a second position relative to said bracket, in said first position said first means for supporting merchandise being in position to support merchandise, and in said second position said second means for supporting merchandise being in position to support merchandise, and a vertical support structure including means for joining with a plurality of said brackets at said means for attachment to a support structure on said brackets, said plurality of brackets and pivotably associated trays being positionable on said support structure one above the other and spaced apart, said brackets including hooks at said second position, and said support structure including openings for receiving said hooks to connect said tray to said support structure.

* * * * *